US006471340B2

(12) United States Patent
Meyer

(10) Patent No.: US 6,471,340 B2
(45) Date of Patent: Oct. 29, 2002

(54) INKJET PRINTHEAD ASSEMBLY

(75) Inventor: Neal W. Meyer, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/781,941

(22) Filed: Feb. 12, 2001

(65) Prior Publication Data

US 2002/0109755 A1 Aug. 15, 2002

(51) Int. Cl.[7] ..... B41J 2/05
(52) U.S. Cl. ..... 347/65; 347/62
(58) Field of Search ..... 347/63, 65, 67, 347/62, 92, 93, 44, 47

(56) References Cited

U.S. PATENT DOCUMENTS 4,847,630 A * 7/1989 Bhaskar et al. ..... 347/63
4,894,664 A * 1/1990 Tsung Pan ..... 347/63
4,896,171 A * 1/1990 Ito ..... 347/63
5,463,412 A * 10/1995 Matsuda ..... 347/43
5,635,968 A 6/1997 Bhaskar et al. ..... 347/59
5,636,441 A 6/1997 Meyer et al. ..... 29/890.1
5,682,188 A 10/1997 Meyer et al. ..... 347/61
5,755,032 A 5/1998 Pan et al. ..... 29/890.1
5,997,713 A 12/1999 Beetz, Jr. et al. ..... 205/124
6,137,443 A 10/2000 Beatty et al. ..... 347/63
6,155,675 A 12/2000 Nice et al. ..... 347/63

* cited by examiner

*Primary Examiner*—Michael P. Nghiem
*Assistant Examiner*—Juanita Stephens

(57) ABSTRACT

The present invention provides an improved inkjet printhead assembly adapted to reduce and/or withstand the collapse of ink back into the firing chambers. In one embodiment, the printhead assembly includes one or more firing chambers disposed on a porous substrate. An ink supply is connected to the substrate so that ink is allowed to flow through the pores of the substrate from the ink supply to the firing chamber. Thus, a substantial amount of the energy created by the impact of ink collapsing back into the firing chamber is expended within the pores of the substrate. In another embodiment, one or more firing resistors are formed in each firing chamber, and disposed adjacent the periphery of the firing chamber out of the direct impact path of collapsing ink.

19 Claims, 5 Drawing Sheets

INKJET PRINTHEAD ASSEMBLY

TECHNICAL FIELD

The present invention relates generally to inkjet printers, and more particularly to an improved inkjet printhead structure.

BACKGROUND

In contrast to many other types of printers, inkjet printers provide fast, high resolution, black-and-white and color printing on a wide variety of media and at a relatively low cost. As a result, inkjet printers have become one of the most popular types of printers for both consumer and business applications. Nevertheless, inkjet technology must continuously advance to keep pace with ever-increasing customer demands for printers that print faster, at a higher resolution, and at a lower cost.

One of the more important components of an inkjet printer is the inkjet printhead. Often housed in, or mounted on, a replaceable ink cartridge, the inkjet printhead controls the application of ink to the printing medium (e.g., paper). Generally, inkjet printheads include a plurality of ink ejection mechanisms formed on a substrate. Each ink ejection mechanism includes a firing chamber with at least one ejection orifice. Each ink ejection mechanism also includes one or more firing resistors located in the firing chamber. The substrate is connected to an ink cartridge or other ink supply. Channel structures formed on the substrate direct the ink from the ink supply to the firing chambers. Control circuitry, located on the substrate and/or remote from the substrate, supplies current to the firing resistors in selected firing chambers. The ink within the selected chambers is super-heated by the firing resistors, causing the ink to be ejected through the chamber orifice toward the printing medium in the form of an ink droplet.

Conventional inkjet cartridges and printheads are well known to those of skill in the art and therefore are not described in more detail herein. Several exemplary printhead configurations are described in the following U.S. Patents, the disclosures of which are herein incorporated by reference: U.S. Pat. No. 5,636,441 to Meyer et al., entitled "Method of Forming a Heating Element for a Printhead"; U.S. Pat. No. 5,682,188 to Meyer et al., entitled "Printhead with Unpassivated Heater Resistors Having Increased Resistance"; and U.S. Pat. No. 6,155,675 to Nice et al., entitled "Printhead Structure and Method for Producing the Same." Inkjet printheads are typically manufactured using standard semiconductor processing methods such as are known to those of skill in the art and described in the above-referenced patents.

One problem that occurs in conventional printhead structures is damage caused to the firing resistors when a portion of an ink droplet breaks away and collapses back into the chamber and onto the resistor. Several approaches have been developed to alleviate this problem. For example, one approach involves forming the firing resistors of thicker layers that are less vulnerable to mechanical stress and impact. Another approach involves forming a protective layer over the resistors to absorb the impact. However, both approaches increase the thermal mass which must be heated to eject the ink, thereby decreasing the thermal efficiency of the ink ejection mechanism. As a result, the delay times between consecutive firings of the ejection mechanisms must be increased, thereby reducing the maximum printing speed of the printhead. Furthermore, additional protective layers increase the complexity and cost of manufacturing the printheads.

SUMMARY

The present invention provides an improved inkjet printhead assembly adapted to reduce and/or withstand the collapse of ink back into the firing chambers. In one embodiment, the printhead assembly includes one or more firing chambers disposed on a porous substrate. An ink supply is connected to the substrate so that ink is allowed to flow through the pores of the substrate from the ink supply to the firing chamber. Thus, a substantial amount of the energy created by the impact of ink collapsing back into the firing chamber is expended within the pores of the substrate. In another embodiment, one or more firing resistors are formed in each firing chamber, and disposed adjacent the periphery of the firing chamber out of the direct impact path of collapsing ink. The peripheral firing resistors may be formed on either a porous or non-porous substrate.

DETAILED DESCRIPTION OF THE PREFERRED EMBODIMENT AND BEST MODE OF CARRYING OUT THE INVENTION

Figure 1:
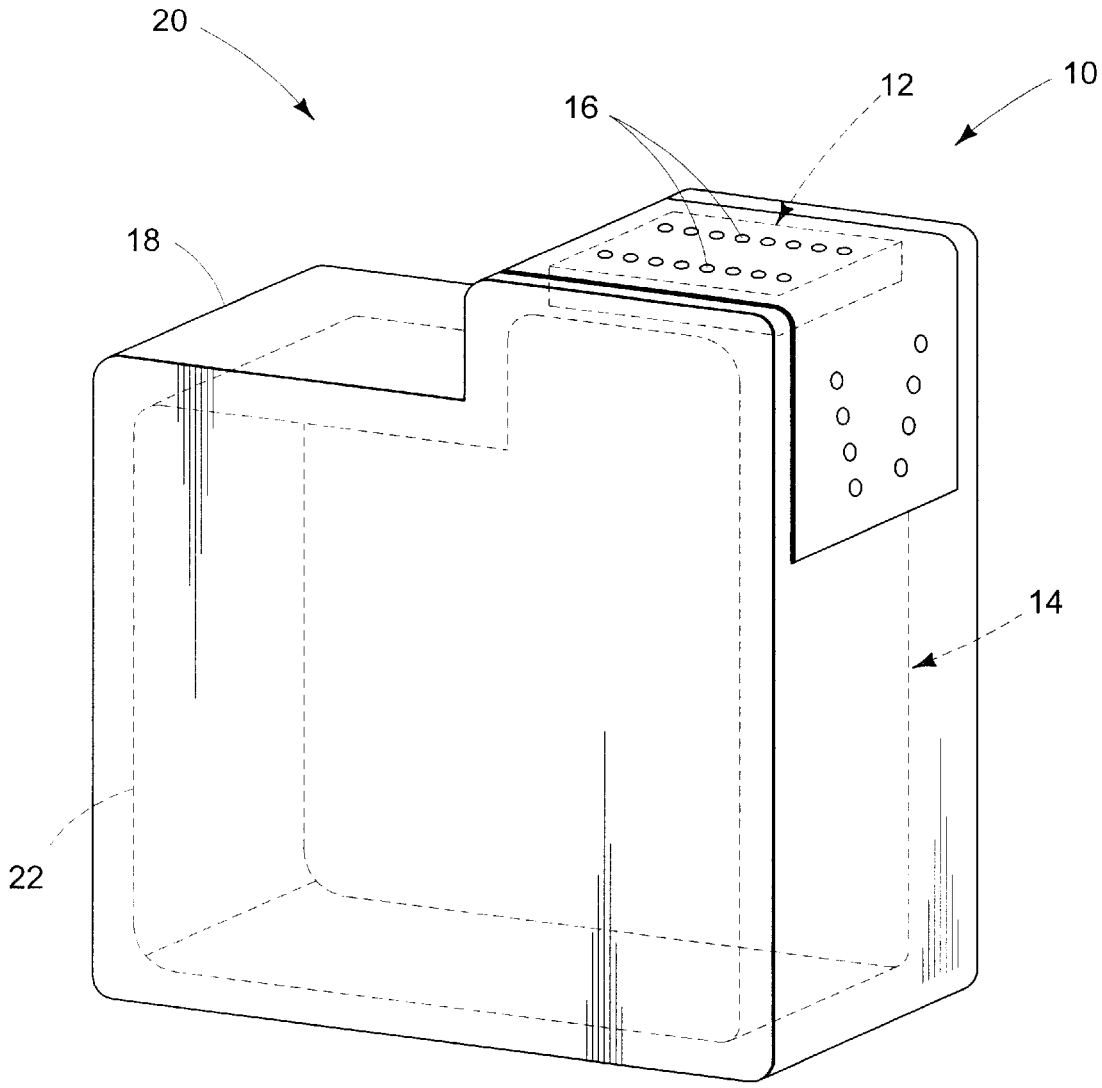
FIG. 1 is a schematic illustration of an exemplary inkjet printhead and cartridge according to the present invention.

An exemplary inkjet printhead assembly or structure according to the present invention is indicated generally at 10 in FIG. 1. Assembly 10 includes a substrate 12 configured to receive ink from an ink supply 14. Assembly 10 also includes one or more ink ejection mechanisms 16 disposed on the substrate and controllable to form images on a printing medium (not shown). Each ink ejection mechanism includes one or more firing resistors configured to selectively eject ink from a firing chamber. Ink ejection mechanisms 16 are configured to reduce and/or withstand the collapse of ink back into the firing chamber.

In the exemplary embodiment depicted in FIG. 1, printhead assembly 10 is mounted within a housing 18 to form a replaceable printer cartridge 20. Ink supply 14 is formed as a reservoir 22 within housing 18. Substrate 12 is connected to a side wall of the reservoir to receive the ink. During printing, cartridge 20 is passed across a printing medium while ink ejection mechanisms 16 selectively eject ink to print a desired image on the medium. As is known to those of skill in the art, inkjet printing is suitable for use with a wide variety of printing media, including paper, cardboard, transparencies, etc.

Alternatively, many other configurations of printhead assembly 10 may be used as necessary or desired for a particular application. As one example, ink supply 14 may be disposed remotely from substrate 12 and connected to supply ink to the substrate through a transfer mechanism such as a flexible tube. This configuration allows the ink reservoir to remain stationary while the printhead is passed across the printing medium. As a result, the amount of weight that must be moved across the medium is substantially reduced, allowing faster printing and larger ink reservoirs. Thus, it will be appreciated that while the invention is described and depicted herein in the context of one particular exemplary configuration, there are many variations possible within the scope of the invention.

Figure 3:
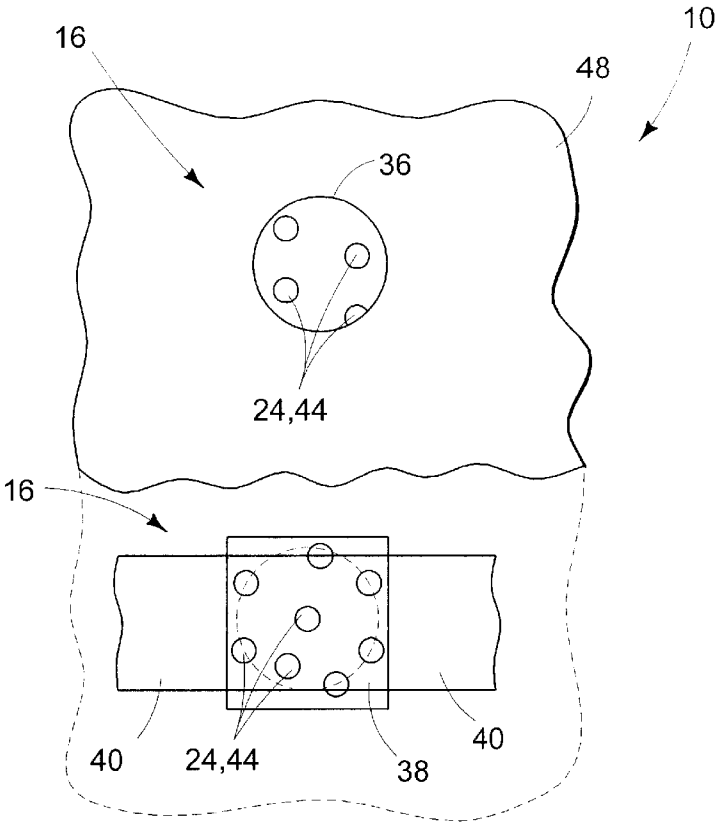
FIG. 3 is a fragmentary, top plan schematic illustration of the printhead structure of FIG. 2, with a portion of the orifice layer removed to show the firing resistor.
Figure 2:
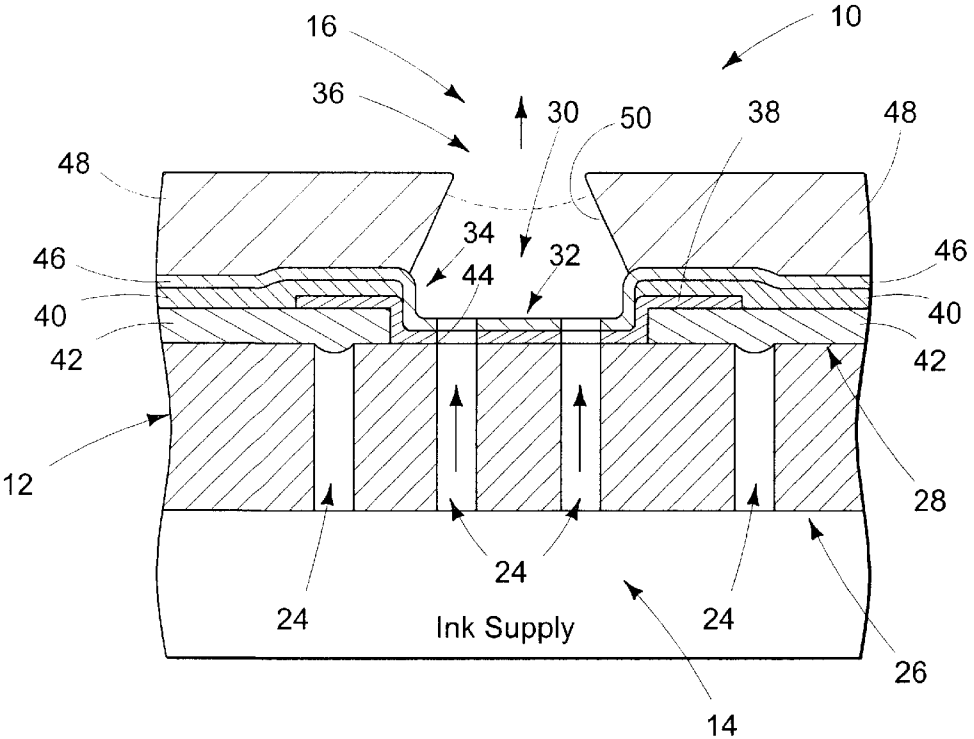
FIG. 2 is a fragmentary, cross-sectional schematic illustration of an exemplary printhead structure according to the present invention.

Turning attention now to FIGS. 2 and 3, one exemplary embodiment of printhead assembly 10 is depicted in which substrate 12 is formed of one or more porous materials (e.g., SiC, Alumina, Si, or a composite sandwich of such porous materials). It should be noted that, in order to schematically illustrate particular details of the invention, FIGS. 2–8 are not drawn to scale. In the embodiment of FIGS. 2 and 3, substrate 12 includes one or more openings or pores 24 extending between a first portion or region 26 of the substrate and a second portion or region 28 of the substrate. Ink supply 14 is connected to first region 26. One or more ink ejection mechanisms 16 are formed or mounted on the substrate adjacent second region 28. Pores 24 are adapted to allow ink to low through the substrate from ink supply 14 to ink ejection mechanisms 16.

Substrate 12 may be formed of any of a variety of different porous materials such as are known to those of skill in the art. In the exemplary embodiment, substrate 12 is formed of porous silicon which typically is created by electrochemically etching single crystal silicon with a solution containing hydrofluoric acid, or by reactive ion etching. Silicon etching is shown, for example, in U.S. Pat. No. 5,997,713 to Beetz, Jr. et al., the subject matter of which is incorporated hereby by this reference.

As shown, porous silicon includes a plurality of generally parallel channels or tunnels oriented along the crystalline planes of the substrate. The size or diameter of the tunnel pores is controlled by varying the conditions of the electrochemical etch. For example, assuming outstanding 150–200 mm Si wafer of approximately 700 micron thickness, the fluid dynamics require a through via roughly 2× the cross sectional area of the exit bore of the firing chamber it supports. Thinner substrates will enable smaller cross section vias. The properties of porous silicon are well known to those of skill in the art. Alternatively or additionally, substrate 12 may be formed from any of a variety of other materials such as micro-porous ceramic membranes typically used in high-purity filtration applications (e.g., aluminum oxide, etc.) or porous Sic as used in AlSic Metal Matrix Composites (MMCS). In contrast to porous silicon, micro-porous ceramic membranes include a plurality of generally randomly oriented and interconnected channels having an average size or diameter.

It will be appreciated that one benefit of the exemplary embodiment described above is that substrate 12 will act to filter the ink before it is received at the ink ejection mechanisms. As a result, additional ink filters which are typically used in conventional printhead assemblies may be eliminated or replaced with coarser filters having higher flow capacities. The average pore size of the porous substrate may be selected to be any of a variety of different sizes depending on the application and the ink being used. Suitable average pore sizes may be in the range of approximately 1 $\mu$m to approximately 50$\mu$m, with a range of approximately 5$\mu$m to approximately 10$\mu$m being more typical. Alternatively, substrates with pore sizes outside these ranges may be used. It should be noted that micro-porous ceramic is a bulk filtration material while porous silicon is a surface filtration material. As a result of the multiple flow paths within a bulk filtration material, a micro-porous substrate may be less susceptible to clogging than a porous silicon substrate with a similar filtration efficiency. One way to address this is to use a hybrid substrate sandwich of micro via Si on top of a bulk filtration structure of SiC or Alumina. This approach allows the use of a thinner Si layer and reduced Si via cross sections, while providing a mechanically or structurally reinforced die that is less prone to breakage. Retaining a Si layer also allows or enables the use of IC multiplexing circuitry, etc. as opposed to the flip chip arrangement.

A pressure control mechanism (not shown) typically is coupled to or contained within ink reservoir 22. The pressure control mechanism is configured to apply and maintain a necessary degree of pressure on the ink within the reservoir to urge the ink to flow through the substrate and into the ink ejection mechanisms to replace the ink that is ejected. The pressure control mechanism may be any of a variety of suitable mechanisms known to those of skill in the art. Alternatively or additionally, other mechanisms may be used to convey ink to the ink ejection mechanisms such as pumps, gravity feeds, etc. In any event, ink flows through the substrate from the first region to the second region, thereby eliminating the need for conventional ink feed structures, etc. Furthermore, since the ink is able to flow at all areas of second region 28, ink ejection mechanisms 16 may be disposed on the substrate without precise alignment to ink flow structures. Thus, the ink ejection mechanisms are essentially "self-aligned" to pores 24. In contrast, conventional ink ejection mechanisms must be precisely aligned to ink fill structures on the substrate. Alternatively, with a Si substrate or hybrid structure, the ink feed vias may be patterned to be placed only where needed adjacent to the firing chambers. This will make more Si "real estate" available for IC devices if needed.

In the exemplary embodiment depicted in FIG. 1, a plurality of ink ejection mechanisms are disposed in a selected arrangement on substrate 12. As shown in FIG. 2, each ink ejection mechanism includes a firing chamber 30 adapted to receive and hold an amount of ink from ink supply 14. Firing chambers 30 may take any one or a combination of different shapes including circular, rectangular, etc. Typically, each firing chamber includes a bottom surface 32 that extends generally parallel to second region 28 of the substrate. One or more side walls 34 extend generally upward from the substrate to an orifice 36 opposite bottom surface 32. Orifice 36 typically is generally circular, but may alternatively have any other suitable shape.

Each ink ejection mechanism also includes one or more firing resistors 38. One or more conductor traces 40 are connected to supply electrical current to firing resistors 38. When the current is passed through resistors 38, the resistors heat the ink in firing chamber 30, causing the ink to be ejected through orifice 36. The firing chamber is then refilled with ink that flows through pores 24.

While a few particular exemplary embodiments are described herein, it will be understood by those of skill in the art that many modifications and alternative configurations are possible. Thus, the invention is not limited to the particular exemplary embodiments but includes all such modifications and alternative configurations. Further, those of skill in the art will also appreciate that the particular embodiments described herein may be formed using a variety of different processes and a variety of different materials. All such processes and materials are to be considered within the scope of the invention.

In the exemplary embodiment depicted in FIGS. 2 and 3, ink ejection mechanisms 16 include one or more capping regions or layers 42 formed on second region 28 of substrate 12. Capping layer 42 functions to cover and seal the pores of the substrate in the second region which are not directly beneath the firing chambers. Thus, ink is unable to flow out of the substrate except at the firing chambers. As a result, the capping layer directs the flow of ink to the firing chambers. Alternatively, the capping layers may be configured to allow ink to flow through the substrate into central ink fill channels (not shown) on second region 28, from which points the ink may be directed toward the ink ejection mechanisms by conventional channel structures on the substrate.

Capping layer 42 may be formed of a variety of different materials such as silicon dioxide, aluminum oxide, silicon carbide, silicon nitride, glass, etc. The use of an electrically insulating dielectric material for capping layer 42 also serves to insulate substrate 12 from conductor traces 40. The capping layer may be formed using any of a variety of methods known to those of skill in the art such as sputtering, evaporation, plasma enhanced chemical vapor deposition (PECVD), etc. Optionally, the porous substrate may be vacuum baked and/or backfilled with argon or another inert gas to reduce outgassing and virtual vacuum leaks during capping layer deposition and subsequent manufacturing steps. Alternatively, the starting substrate may be a Metal Matrix Composite (MMC), a Ceramic Matrix Composite (CMC), a Polymer Matrix Composite (PMC) or a sandwich Si/xMc, in which the x filler material is etched out of the composite matrix post vacuum processing in order to provide a porous structure.

The thickness of capping layer 42 may be any desired thickness sufficient to cover and seal pores 24. After deposition, capping layer 42 is patterned, such as by photolithography, and etched by suitable known methods to define openings to the substrate beneath and/or adjust firing chambers 30. Firing resistors 38 are then formed by depositing a layer of one or more resistive materials over the openings in the capping layer. The resistor layer is then patterned and etched to form individual resistors disposed within the firing chambers. A variety of suitable resistive materials are known to those of skill in the art including tantalum aluminum, nickel chromium, titanium nitride, etc., which may optionally be doped with suitable impurities such as oxygen, nitrogen, carbon, etc., to adjust the resistivity of the material. The resistive material may be deposited by any suitable method such as sputtering, evaporation, etc.

In the exemplary embodiment, the resistor layer is deposited directly over the porous substrate material which is exposed by the openings in the capping layer. The thickness of the resistor layer is selected to prevent the clogging of pores 24, and therefore may vary depending on the average pore size of the substrate. Typically, the resistor layer has a thickness in the range of 100Å–300 Å. However, resistor layers with thicknesses outside this range are also within the scope of the invention. Each resistor takes the form of a resistive "mesh" having one or more holes 44 aligned with the pores of the substrate. As a result, ink is allowed to flow through both substrate 12 and firing resistors 38 to fill firing chambers 30.

After firing resistors 38 have been formed, an electrically conductive material is deposited over the capping layer and resistors. The conductive layer is patterned and etched as described above to define conductor traces 40. The conductive layer may be formed of any of a variety of different materials including aluminum/copper(4%), copper, gold, etc., and may be deposited by any suitable method such as sputtering, evaporation, etc.

In the event that an electrically conductive ink will be used, an insulating passivation layer 46 may be formed over the resistors and conductive traces to prevent electrical charging of the ink or corrosion of the device. Passivation layer 46 may be formed of any suitable material such as silicon dioxide, aluminum oxide, silicon carbide, silicon nitride, glass, etc., and by any suitable method such as sputtering, evaporation, PECVD, etc. The thickness of the passivation layer is selected to prevent the clogging of pores 24, thereby allowing ink to flow through the passivation layer and into firing chamber 30. Alternatively, passivation layer 46 may be omitted if a non-conductive ink will be used.

Finally, an orifice layer 48 is formed or attached to substrate 12. Orifice layer 48 may be formed of any of a variety of suitable materials such as are known in the art. Examples of suitable orifice layers include electroplated nickel, non-metallic polymer materials such as polyimide, etc. More detailed descriptions of the materials and processes used to form orifice layers may be found in the U.S. patents listed above, as well as in U.S. Pat. No. 6,137,443 to Beatty et al., which is herein incorporated by reference. In any event, orifice layer 48 is patterned to form an ejection orifice 36 at each firing chamber. Typically, the inner walls 50 of each orifice 36 are tapered or inclined inwardly as the orifice layer extends away from the substrate. This inward taper promotes the formation of a meniscus layer (indicated by dash line in FIG. 2) on the ink held within the firing chamber to prevent the ink from spilling out of the orifice or de-priming out of the firing chamber.

Compared with conventional solid-surface firing resistor configurations, the mesh resistor embodiment described above is configured to better withstand the impact of ink which collapses back into the firing chamber because a substantial amount of the energy of impact is expended within the pores of the substrate rather than on the resistors. As a result, resistors 38 may be thinner and/or the conventional protective layer over the resistors may be eliminated. In addition, passivation layer 46, which also protects the firing resistors from impact, may be thinner or eliminated. In any case, the thermal mass which must be heated by the firing resistors is reduced, thereby enabling a higher firing frequency.

In addition to reducing the impact energy experienced by the firing resistors, the use of a porous substrate to feed ink through the bottom surface of the firing chamber also enables a wide variety of complex resistor and firing chamber designs. This allows designers to control various characteristics of the ink ejection such as droplet shape, trajectory, collapse volume, etc. It will be appreciated by those of skill in the art that many different firing resistor and firing chamber shapes and configurations are possible within the scope of the invention including donut shapes, star shapes, serpentine patterns, zig-zag patterns, checkerboard patterns, etc.

Figure 5:
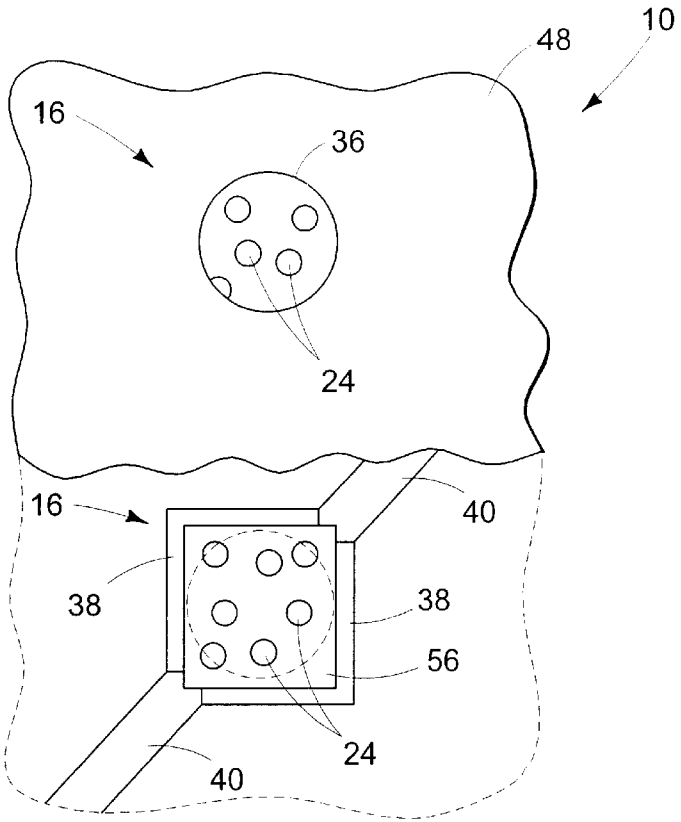
FIG. 5 is a fragmentary, top plan schematic illustration of the printhead structure of FIG. 4, with a portion of the orifice layer removed to show the firing resistor.
Figure 4:
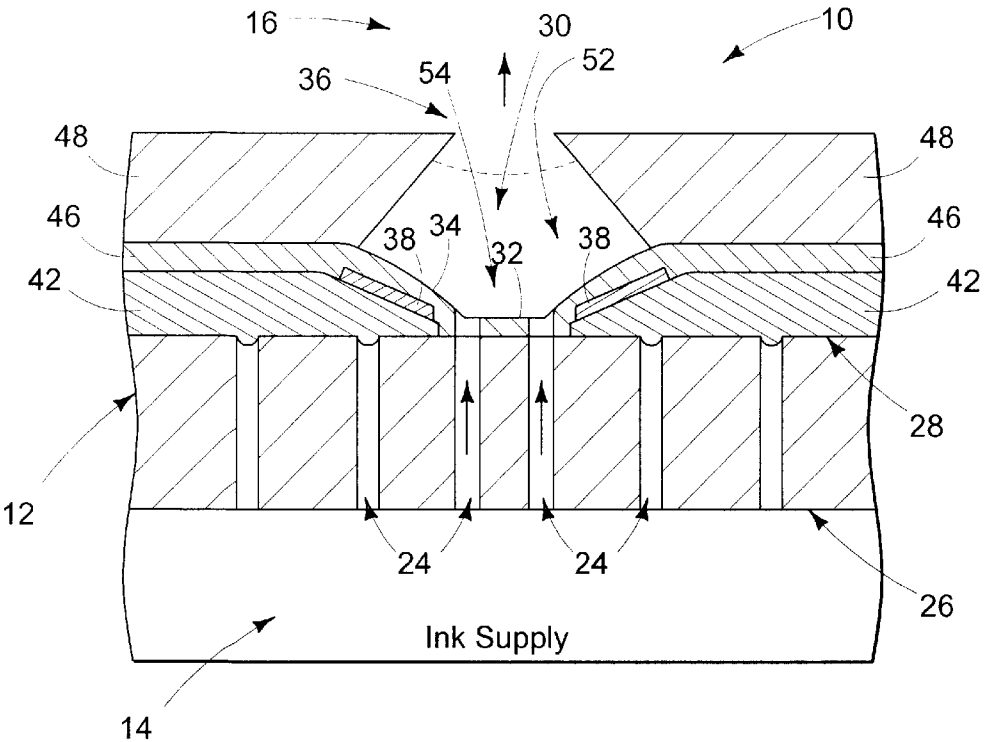
FIG. 4 is a fragmentary, cross-sectional schematic illustration of another exemplary printhead structure according to the present invention.

In addition to the examples mentioned above, a circumferential firing resistor is another example of the many different complex resistor designs which are possible and which allow improved ink ejection characteristics. One type of circumferential resistor is referred to herein as a "box" resistor, an exemplary embodiment of which is depicted in FIGS. 4 and 5. After depositing the resistive layer over capping layer 42, firing resistors 38 are patterned to define a rectangular ring. The resistors are formed with a central opening 56 to allow ink to flow into the chamber through pores 24. Alternatively, the circumferential resistors may take any other suitable shape (e.g., circle, oval, triangle, etc.).

In the exemplary embodiment, the firing chamber 30 includes a peripheral region 52 at least partially surrounding a central region 54. Firing resistors 38 are disposed adjacent or within the peripheral region, and spaced apart from the central region. It will be appreciated that most of the impact energy of the collapsing ink is expended on bottom surface 32 directly beneath orifice 36. Thus, positioning the firing resistors adjacent the periphery of the firing chamber ensures that the resistors are out of the direct impact path of the collapsing ink. As a result, the conventional protective layer may be eliminated. In addition, a thinner resistor layer may be used and/or passivation layer 46 may be eliminated. As discussed above, this reduction in thermal mass provides printhead assembly 10 with improved thermal efficiency.

Another aspect of the exemplary embodiment depicted in FIGS. 4 and 5 is the shape of firing chamber 30. As can be seen, at least portions of side walls 34 are inclined outward as the side walls extend away from substrate 12. Firing resistors 38 are formed on the side walls so that ink held within the firing chamber is heated at the periphery of the chamber rather than at bottom surface 32. Alternatively, firing resistors 38 may be positioned on both the side walls and the bottom surface to heat the ink at both regions.

In any event, computer simulations of the ink ejection mechanism depicted in FIGS. 4 and 5, as well as other ink ejection mechanisms having circumferential firing resistors, demonstrate an improved thermal efficiency and a reduced amount of ink collapsing back into the chamber. It is believed that by placing the resistors at the periphery of the firing chamber, only the peripheral portion of the ink need be heated since the ink held at the center of the firing chamber is ejected along with the surrounding ink at the periphery. Because only a portion of the ink must be heated to obtain substantially complete ejection, less heating is required and the thermal efficiency is increased. Furthermore, the ejected ink tends to form a more coherent droplet which does not partially break apart and collapse back into the firing chamber as with conventional designs.

Figure 6:
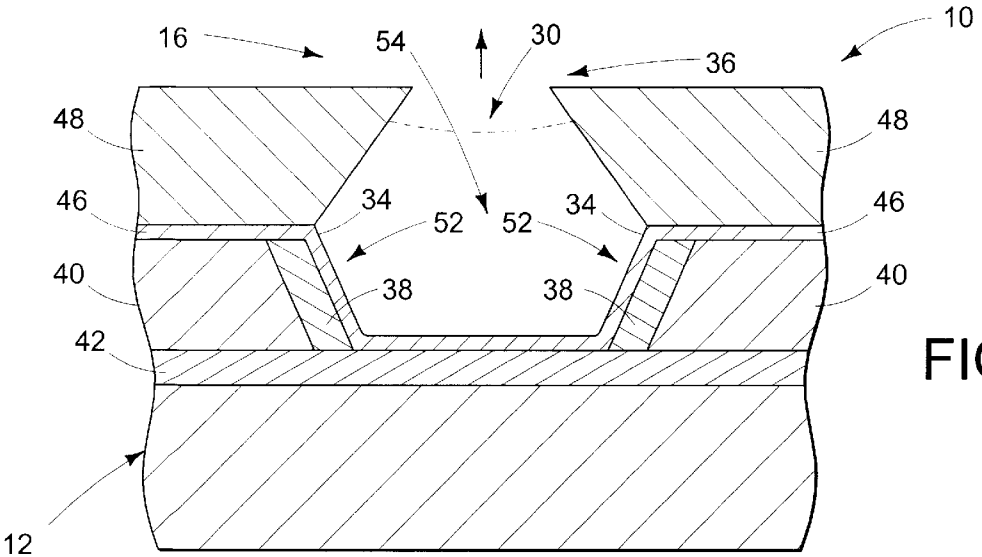
FIG. 6 is a fragmentary, cross-sectional schematic illustration of another exemplary printhead structure according to the present invention.
Figure 7:
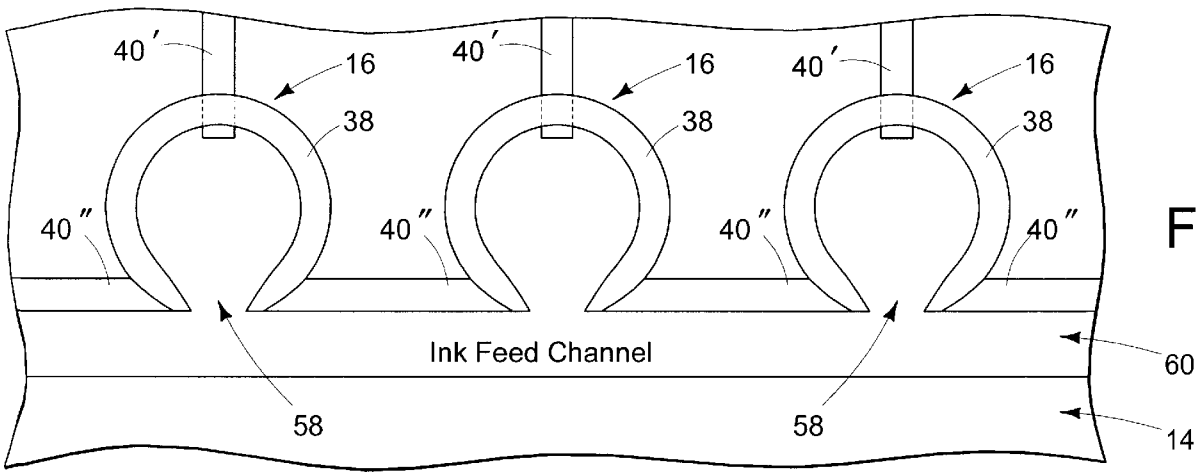
FIG. 7 is a fragmentary, top plan schematic illustration of the printhead structure of FIG. 6, with the orifice layer removed to show the firing resistors.

While an ink ejection mechanism configuration with peripheral firing resistors has been described above as suited for use with a porous substrate, it will be appreciated that similar ink ejection mechanisms may also be used with conventional, non-porous substrates. For example, another exemplary embodiment which includes peripheral firing resistors is depicted in FIGS. 6 and 7. As shown, ink ejection mechanisms 16 include generally circular firing chambers 30 with lateral ink feed openings 58. Substrate 12 includes one or more ink feed channels 60 adapted to carry ink from ink supply 14, through openings 58 and into the firing chambers.

At least portions of side walls 34 are inclined outward as the side walls extend away from the substrate. Firing resistors 38 are formed on the inclined side walls and covered by passivation layer 46. Alternatively, the passivation layer may be eliminated where electrically non-conductive ink will be used. In any event, the exemplary firing chamber depicted in FIGS. 6 and 7 has a quasi-hemispherical shape with the firing resistors disposed about the lower periphery. As with the embodiment depicted in FIGS. 4 and 5, the configuration of the embodiment depicted in FIGS. 6 and 7 not only ensures that the resistors are out of the direct path of any collapsing ink, but also provides improved fluid dynamic efficiency and ink droplet formation to reduce or eliminate the ink which collapses back into the chamber.

The exemplary embodiment of FIGS. 6 and 7 also illustrates an alternative configuration of the conductor traces. As shown, the resistive layer is patterned to define substantially circular rings within the firing chambers. Each ink ejection mechanism includes a separate conductive trace 40' that contacts a generally central portion of the ring. The ends of adjacent rings are connected together by a plurality of common traces 40". The common traces are grounded to orifice layer 48. This arrangement forms two firing resistors in each firing chamber, one on each side of separate trace 40'. Each ink ejection mechanism is activated by applying voltage to the corresponding separate trace 40'. Current runs through both resistors to corresponding common traces 40". It will be appreciated that by using common ground traces, ink ejection mechanisms 16 may be more densely arranged, thereby providing increased resolution.

Figure 8:
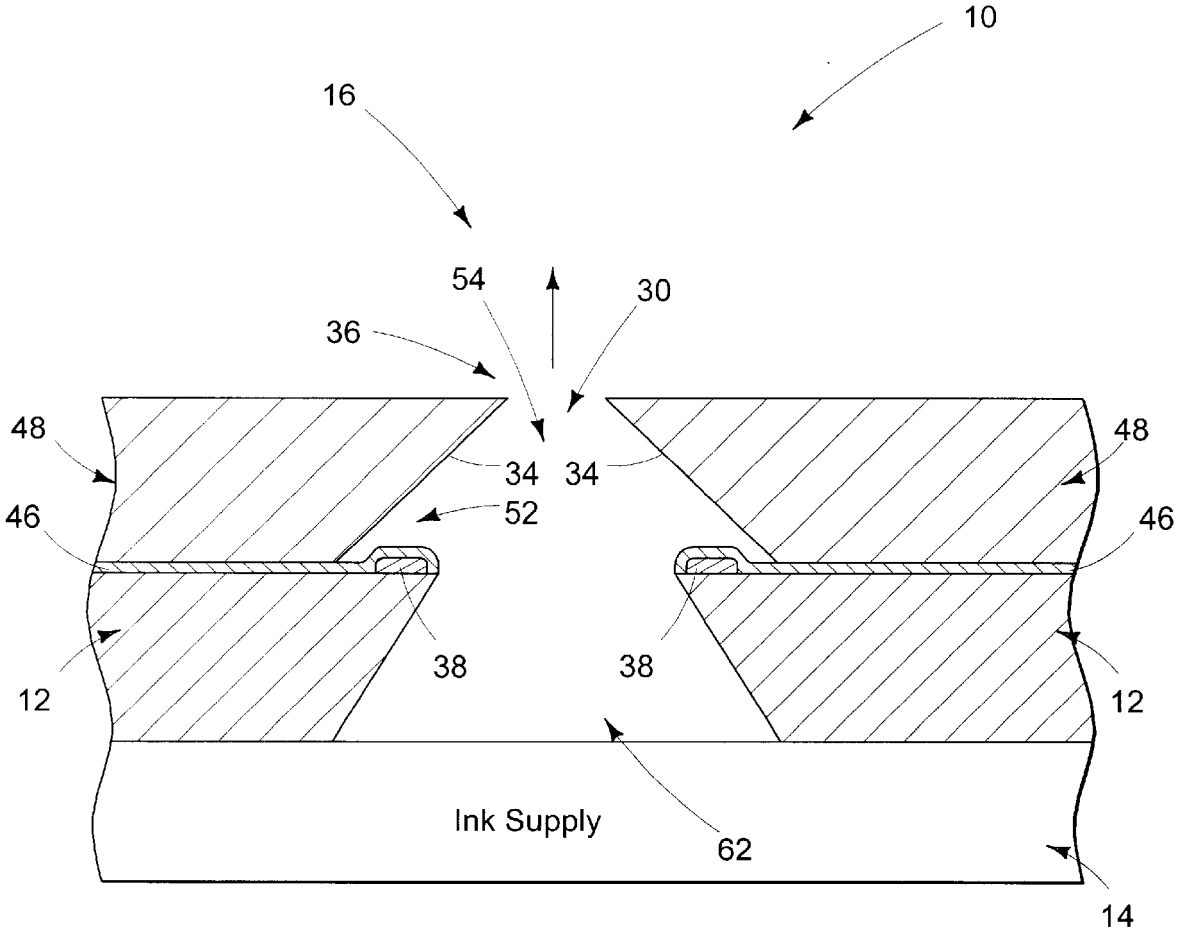
FIG. 8 is a fragmentary, cross-sectional schematic illustration of another exemplary printhead structure according to the present invention.

Turning attention now to FIG. 8, another exemplary embodiment of printhead assembly 10 is depicted in which the firing resistors are positioned at the periphery of the firing chamber. As shown, ink ejection mechanism 16 is formed on a non-porous substrate. One or more ink fill holes 62 are formed in the substrate beneath each ink ejection mechanism to allow ink to flow through the substrate from the ink supply to the firing chamber. Holes 62 may be formed in any of a variety of ways known to those of skill in the art. For example, where substrate 12 is single crystal silicon, holes 62 may be formed by reactive ion etching (RIE) anisotropic etching using tetra-methly ammonium hydroxide or other suitable etchants.

One or more firing resistors 38 are disposed adjacent the periphery of each firing chamber between side walls 34 and the rim of ink fill hole 62. The size of ink feed hole 62 may be adjusted to provide the desired fluid dynamics and pressure regulation. The firing resistors may be patterned to define any desired shape, such as the box resistor shape illustrated in FIG. 5. Although the resistors are shown in FIG. 8 as being formed directly on substrate 12, it will be appreciated that alternative configurations are also possible. For example, the resistors may be formed on inclined wall structures such as shown in FIGS. 4 and 6. Although not illustrated in FIG. 8, it will be appreciated that conductive traces may be formed to connect to selected portions of firing resistors 38. In any event, the firing resistors are disposed out of the direct path of impact from collapsing ink, and therefore are less vulnerable to damage.

As described above, the invention provides various novel inkjet printhead structures configured to reduce and/or withstand the impact of ink collapsing back into the firing chambers during ejection. In addition, the disclosed printhead structures provide improved thermal efficiencies over conventional designs.

INDUSTRIAL APPLICABILITY

The present invention is applicable to inkjet printers and print cartridges. Accordingly, while the present invention has been shown and described with reference to the foregoing preferred embodiments, it will be apparent to those skilled in the art that other changes in form and detail may be made therein without departing from the spirit and scope of the invention as defined in the appended claims.

What is claimed is:

1. A printhead assembly, comprising:

a substrate having a first region and a second region;

a fluid supply connected to the first region; and one or more fluid ejection mechanisms disposed on the substrate adjacent the second region, each adapted to selectively eject an amount of fluid away from the substrate;

wherein each fluid ejection mechanism includes:

a firing chamber having a central region at least partially surrounded by a periphery, and one or more firing resistors disposed within the chamber adjacent the periphery and spaced-apart from the central region; and wherein the substrate Is sufficiently porous between the first region and the second region to allow fluid to flow through the substrate from the fluid supply to the one or more fluid ejection mechanisms.

2. The assembly of claim 1, wherein the substrate is at least partially formed of a porous ceramic material.

3. The assembly of claim 1, wherein the substrate is at least partially formed of porous silicon.

4. The assembly of claim 1, wherein the substrate defines a plurality of pores having an average diameter in the range of approximately 1 $\mu$m to approximately 50 $\mu$m.

5. The assembly of claim 4, wherein the plurality of pores have an average diameter In the range of approximately 5 $\mu$m to approximately 10 $\mu$m.

6. The assembly of claim 1, wherein one or more of the fluid ejection mechanisms includes at least one firing resistor.

7. The assembly of claim 6, wherein the substrate defines a plurality of pores, and wherein the at least one firing resistor is formed to define one or more holes aligned with one or more of the pores to allow fluid to flow through the resistor.

8. The assembly of claim 6, wherein the substrate defines a plurality of pores, and wherein the at least one firing resistor is formed on the substrate as a mesh to allow fluid to flow through the resistor.

9. A method for forming a printhead, comprising:

providing a substrate comprised of one or more porous materials adapted to allow fluid to flow through the substrate from a first portion of the substrate to a second portion of the substrate;

connecting a fluid supply to the first portion of the substrate; and forming one or more fluid ejection mechanisms on a second portion of the substrate, wherein each fluid ejection mechanism is configured to receive fluid flowed through the substrate from the fluid supply and selectively eject the received fluid away from the substrate and wherein forming one or more fluid ejector mechanisms includes forming one or more firing chambers on the substrate, each firing chamber having a central region and a periphery at least partially surrounding the central region, and forming one or more firing resistors in at least one of the firing chambers, wherein the one or more firing resistors are disposed adjacent the periphery and spaced-apart from the central region of the firing chamber.

10. The method of claim 9, further comprising forming one or more capping regions on the substrate configured to direct the flow of fluid from the fluid supply to the one or more fluid ejection mechanisms.

11. The method of claim 9, wherein the step of forming one or more fluid ejector mechanisms includes forming one or more mesh firing resistors to allow fluid to flow through the resistor.

12. A printhead structure, comprising:

a substrate with a first side and a second side;

a fluid supply connected to the first side of the substrate;

one or more firing chambers disposed on the second side of the substrate and configured to receive fluid from the fluid supply, wherein each chamber includes a central region and a peripheral region at least partially surrounding the central region; and one or more firing resistors disposed within at least one of the chambers and controllable to eject fluid out of the at least one chamber, wherein the one or more resistors are disposed in the peripheral region and spaced-apart from the central region.

13. The structure of claim 12, wherein the peripheral region of the at least one chamber includes one or more side walls extending away from the substrate, and wherein the one or more resistors are disposed on at least one of the side walls.

14. The structure of claim 13, wherein at least portions of the one or more side walls Incline outward from the central region as the side walls extend away from the substrate.

15. The structure of claim 12, wherein the one or more resistors are covered by at least one passivation layer to electrically insulate fluid received in the chamber from the one or more resistors.

16. The structure of claim 12, wherein the one or more resistors are not covered by a passivation layer so that fluid received in the chamber contacts the one or more resistors.

17. A printhead structure, comprising:

a substrate;

a fluid supply connected to the substrate;

one or more firing chambers disposed on the substrate and configured to receive fluid from the fluid supply, wherein each firing chamber includes an orifice, a bottom surface, and one or more side walls extending generally upward from the bottom surface toward the orifice; and one or more firing resistors disposed on one or more of the side walls within each of the firing chambers;

wherein the substrate and the bottom surface of each firing chamber includes one or more openings adapted to allow fluid to flow from the fluid supply, through the substrate and bottom surface, and into the firing chamber.

18. The structure of claim 17, wherein at least portions of the one or more side walls incline outward as the side walls extend upward from the bottom surface.

19. A fluid ejection device comprising:

a substrate having a first region and a second region;

a fluid supply connected to the first region; and one or more fluid ejection mechanisms disposed on the substrate adjacent the second region, each adapted to selectively eject an amount of fluid away from the substrate;

wherein each fluid ejection mechanism includes:

a firing chamber having a central region at least partially surrounded by a periphery, and one or more firing resistors disposed within the chamber adjacent the periphery and spaced-apart from the central region; and wherein the substrate is sufficiently porous between the first region and the second region to allow fluid to flow through the substrate from the fluid supply to the one or more fluid ejection mechanisms.

* * * * *